US009790946B2

(12) United States Patent
Ohtachi et al.

(10) Patent No.: US 9,790,946 B2
(45) Date of Patent: Oct. 17, 2017

(54) EXHAUST PUMP

(75) Inventors: Yoshinobu Ohtachi, Funabashi (JP); Yasushi Maejima, Katsushika (JP); Tsutomu Takaada, Funabashi (JP)

(73) Assignee: Edwards Japan Limited, Chiba (JP)

( * ) Notice: Subject to any disclaimer, the term of this patent is extended or adjusted under 35 U.S.C. 154(b) by 864 days.

(21) Appl. No.: 13/820,468

(22) PCT Filed: Jul. 21, 2011

(86) PCT No.: PCT/JP2011/066577

§ 371 (c)(1),
(2), (4) Date: Mar. 1, 2013

(87) PCT Pub. No.: WO2012/043027

PCT Pub. Date: Apr. 5, 2012

(65) Prior Publication Data

US 2013/0164124 A1 Jun. 27, 2013

(30) Foreign Application Priority Data

Sep. 28, 2010 (JP) ..... 2010-216909

(51) Int. Cl.
*F04D 19/04* (2006.01)
*F04D 1/00* (2006.01)
(Continued)

(52) U.S. Cl.
CPC ..... *F04D 19/042* (2013.01); *F04D 1/00* (2013.01); *F04D 19/044* (2013.01); *F04D 29/058* (2013.01); *F04D 29/644* (2013.01)

(58) Field of Classification Search
CPC ..... F04D 19/04; F04D 19/042; F04D 19/044; F04D 19/046; F04D 29/058;
(Continued)

(56) References Cited

U.S. PATENT DOCUMENTS 4,023,920 A * 5/1977 Bachler ..... F04D 19/048 415/90
5,344,262 A * 9/1994 Hatayama ..... B23D 3/06 409/307
(Continued)

FOREIGN PATENT DOCUMENTS

JP DE 4113122 A1 * 10/1991 ..... F04D 19/044
JP H0538389 * 5/1993 ..... F04D 19/04
(Continued)

OTHER PUBLICATIONS

U.S. Appl. No. 13/820,468—Proquest translation of DE4113122.*
(Continued)

*Primary Examiner* — Theodore Stigell
*Assistant Examiner* — Jon Hoffmann
(74) *Attorney, Agent, or Firm* — Theodore M. Magee; Westman, Champlin & Koehler, P.A.

(57) ABSTRACT

An exhaust pump includes: a cylindrical rotating member; an outer cylindrical fixed member; an inner cylindrical fixed member a helical inner thread groove exhaust passage provided between the cylindrical rotating member and the inner cylindrical fixed member; connecting opening portions that are opened in the cylindrical rotating member and that lead a part of gas existing in the vicinity of the outer periphery of the cylindrical rotating member towards the inner thread groove exhaust passage. A gap between an upstream end of the connecting opening portions and lowermost stage rotor blades provided at the outer periphery of the cylindrical rotating member which is located upstream of the connecting opening portions has a dimension equal to or greater than a dimension that enables insertion, into the gap, of a tool for opening the connecting opening portions.

9 Claims, 14 Drawing Sheets

(51) Int. Cl.
*F04D 29/64* (2006.01)
*F04D 29/058* (2006.01)

(58) Field of Classification Search
CPC ..... F04D 29/644; F04D 29/052; F04D 5/001; F04D 1/00; F04B 49/22; F04B 49/03; F04B 49/20; F04B 49/225; F04B 49/035; F04B 53/20; F01D 1/36
USPC ..... 83/875, 651; 415/90; 417/423.4, 1
See application file for complete search history.

(56) References Cited

U.S. PATENT DOCUMENTS

| | | | | |
|---|---|---|---|---|
| 6,095,754 | A * | 8/2000 | Ono | F04D 19/04 416/224 |
| 7,354,254 | B2 * | 4/2008 | Gotta | F04D 19/046 417/201 |
| 2006/0140794 | A1 * | 6/2006 | Schofield | F04D 19/048 417/423.4 |
| 2009/0196734 | A1 * | 8/2009 | Kawashima | F04D 17/168 415/90 |

FOREIGN PATENT DOCUMENTS

| | | | |
|---|---|---|---|
| JP | 06-063813 | A | 3/1994 |
| JP | 06-155135 | A | 6/1994 |
| JP | 07-111195 | B2 | 11/1995 |
| JP | 2003-148378 | A | 5/2003 |
| JP | 2003-148379 | A | 5/2003 |

OTHER PUBLICATIONS

U.S. Appl. No. 13/820,468—Proquest transleation of JP H0538389.*
PCT International Search Report of International Application No. PCT/JP2011/066577; dated Oct. 18, 2011.
PCT Written Opinion of the International Search Authority of International Application No. PCT/JP2011/066577; dated Oct. 18, 2011.
Microfilm of the specification and drawings annexed to the request of Japanese Utility Model Application No. 044349/1990.(Laid-open No. 006593/1992)(Seiko Instruments Inc.), Jan. 21, 1992.
Microfilm of the specification and drawings annexed to the request of Japanese Utility Model Application No. 087226/1991.(Laid-open No. 038389/1993) (Seiko Instruments Inc.), May 25, 1993.

* cited by examiner

[FIG.1]
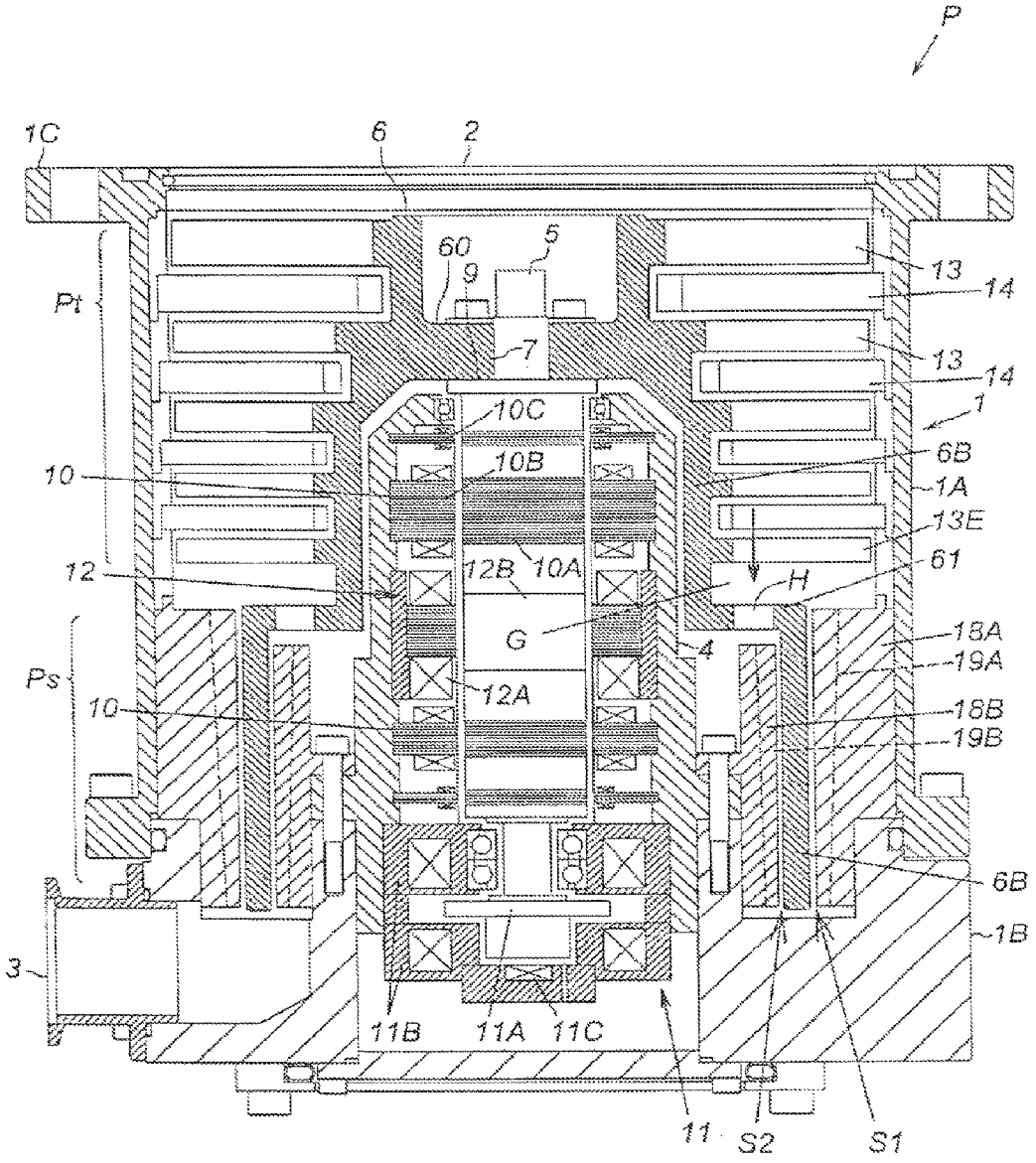
PRIOR ART

[FIG.2]
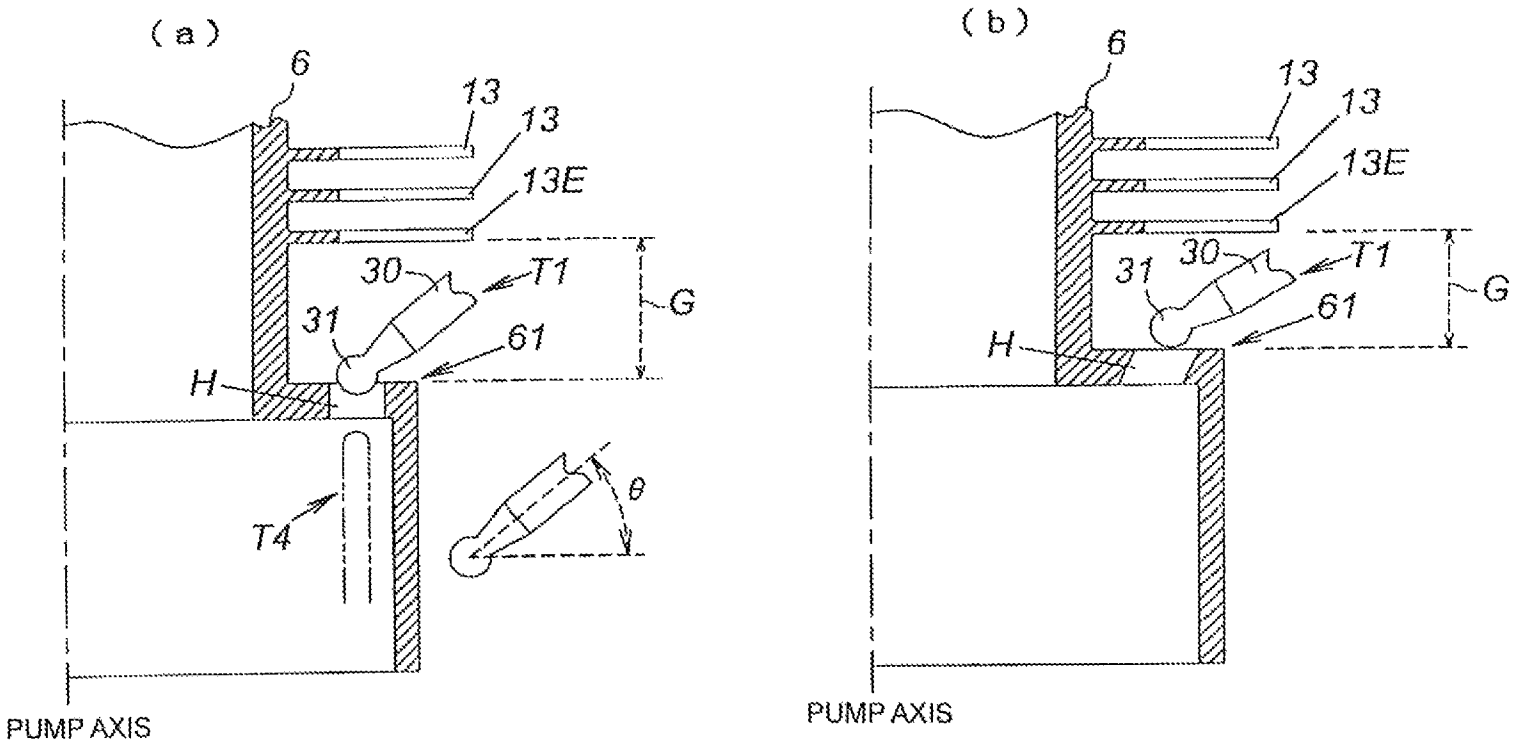

[FIG.3]
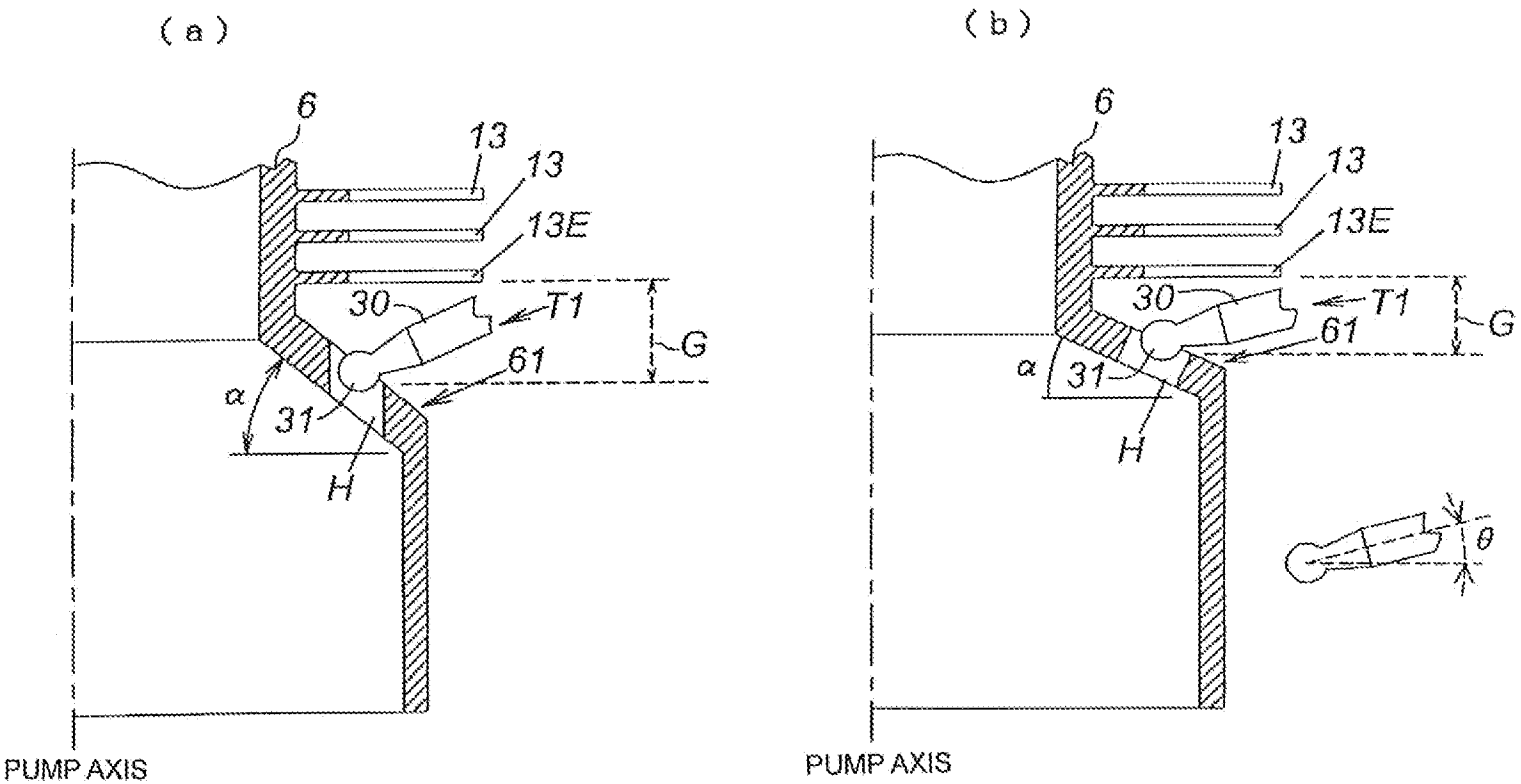

[FIG.4]
(a)
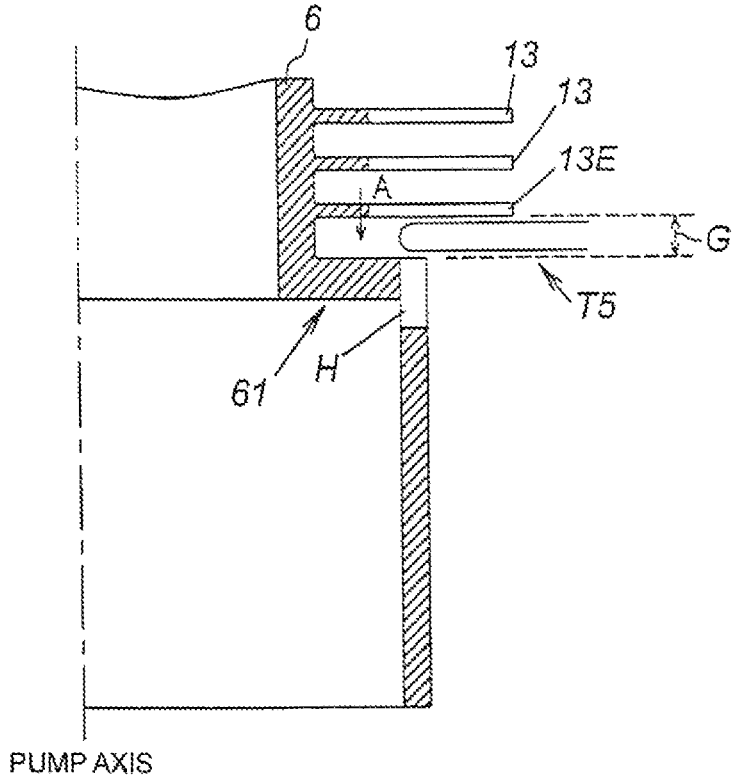
(b)
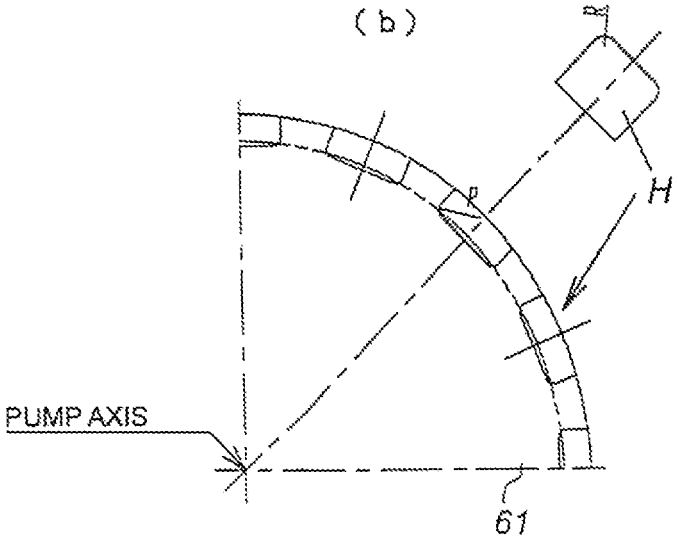

[FIG.5]
(a)
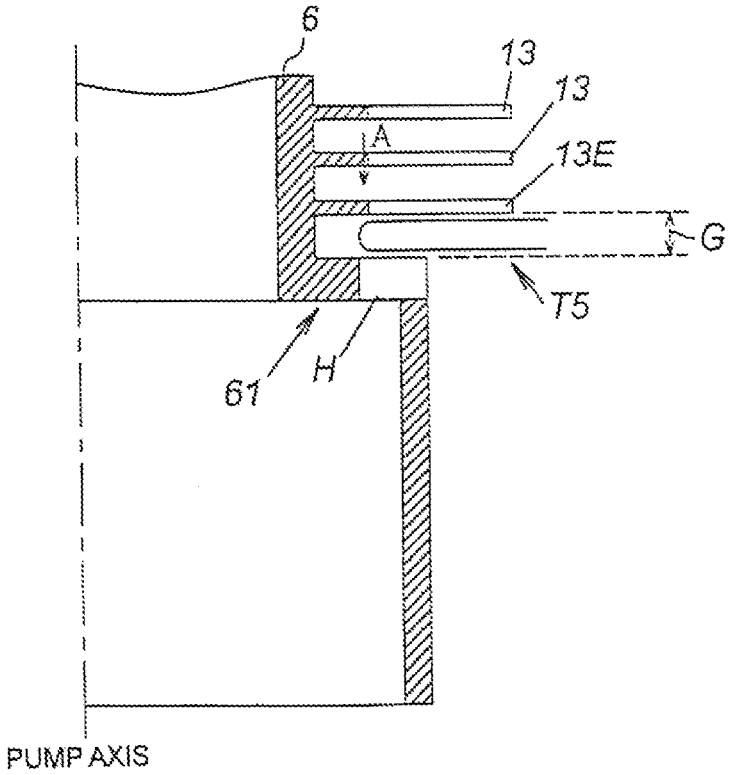
(b)
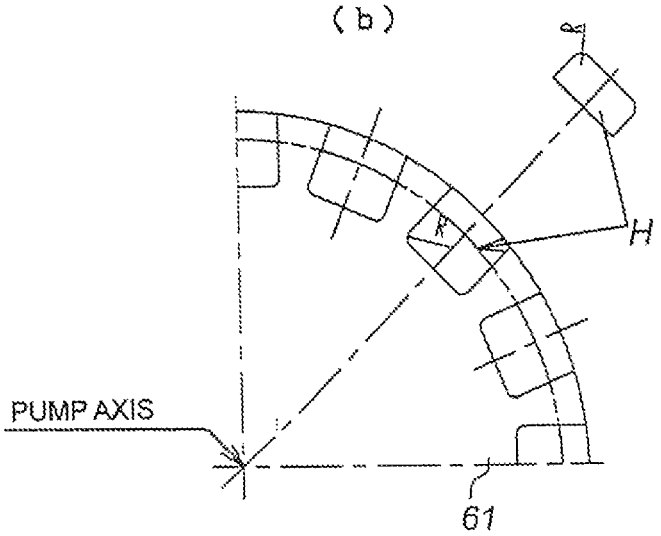

[FIG.6]
(a)
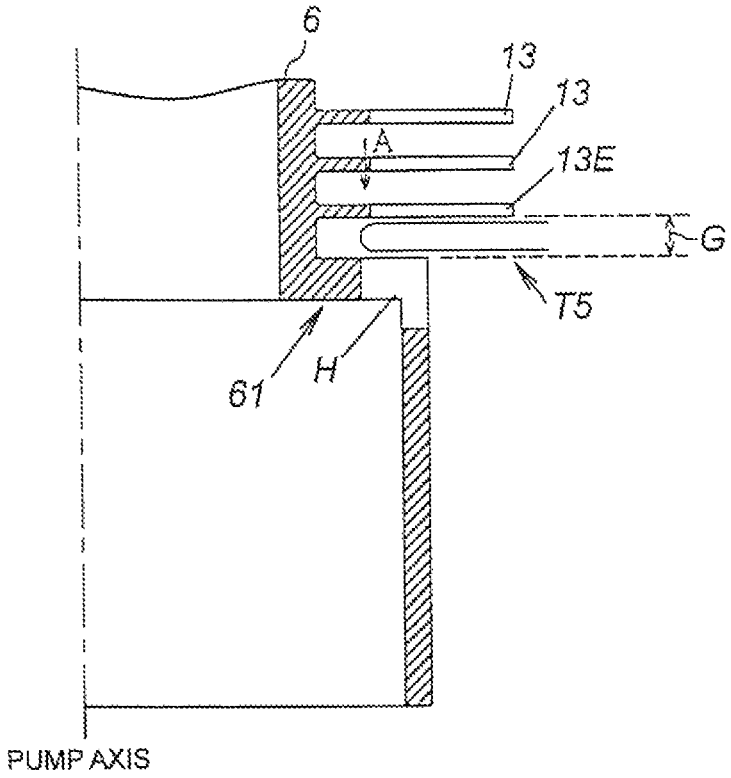
(b)
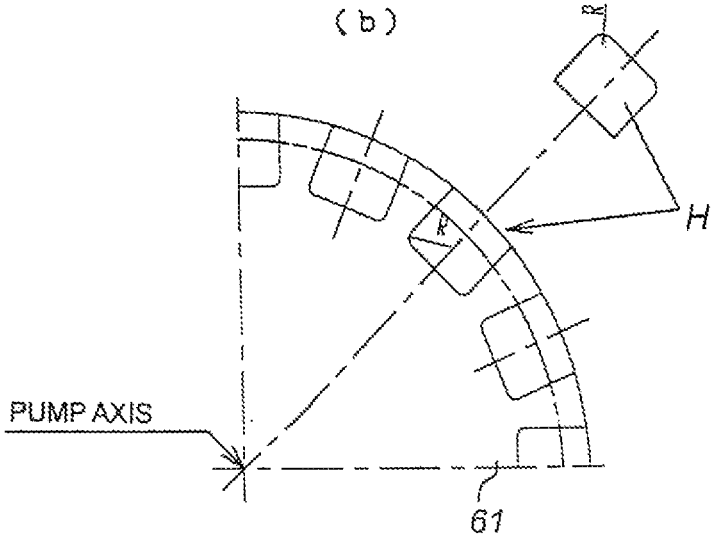

[FIG.7]
(a)
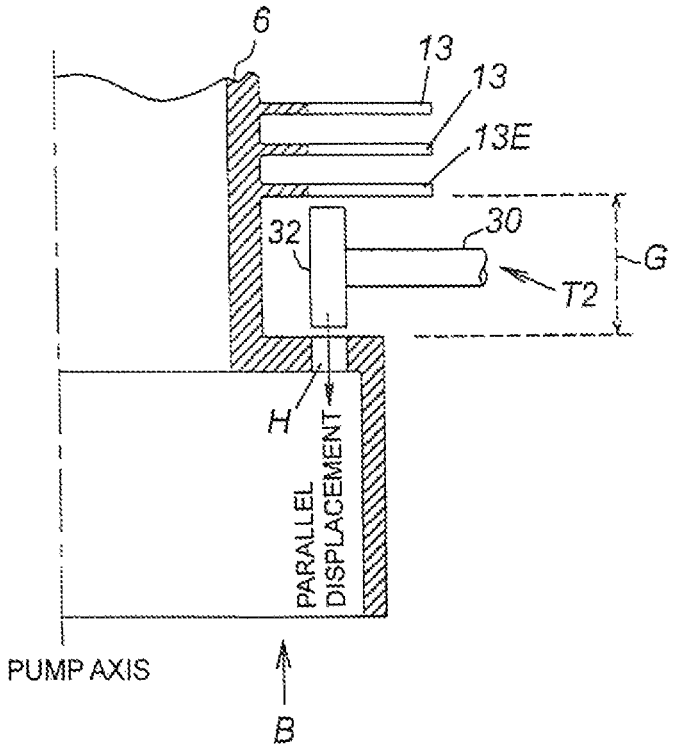
(b)
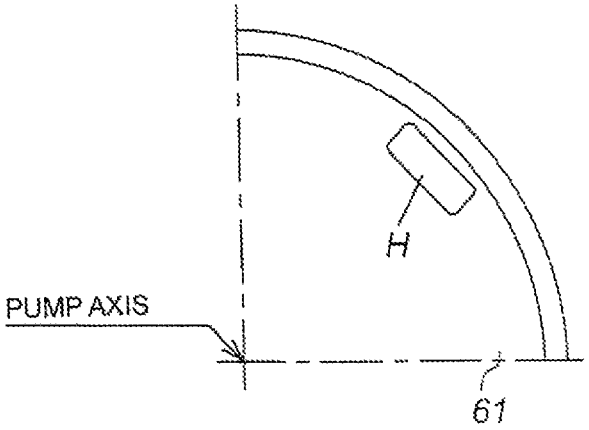

[FIG.8]
(a)
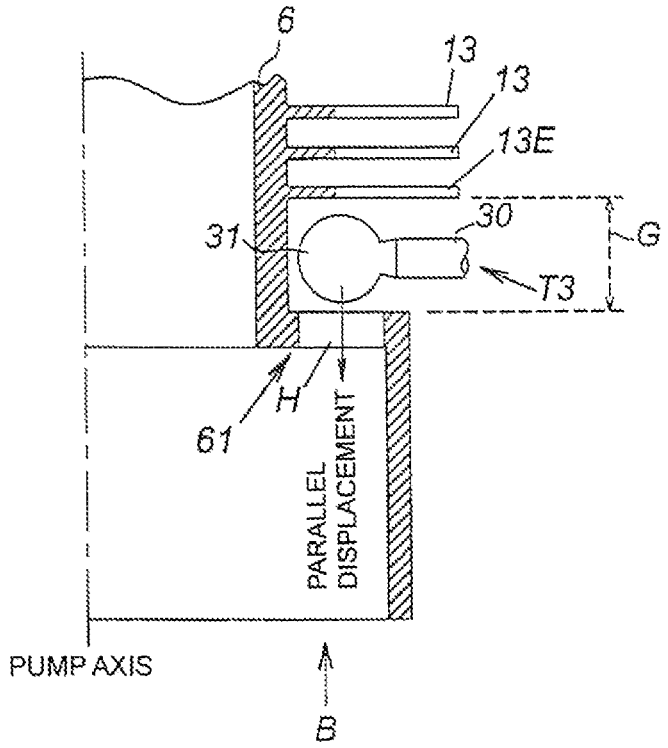
(b)
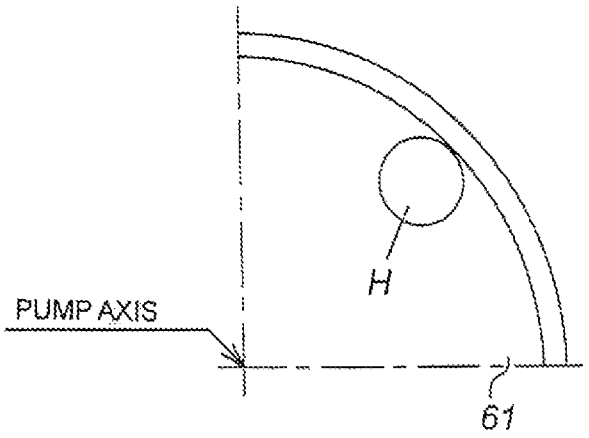

[FIG.9]
(a)
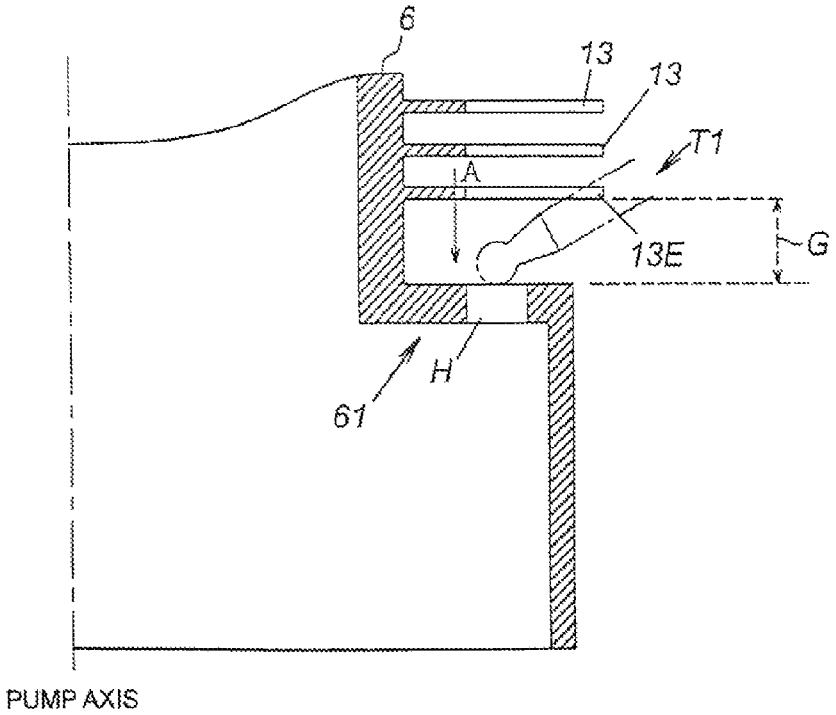
(b)
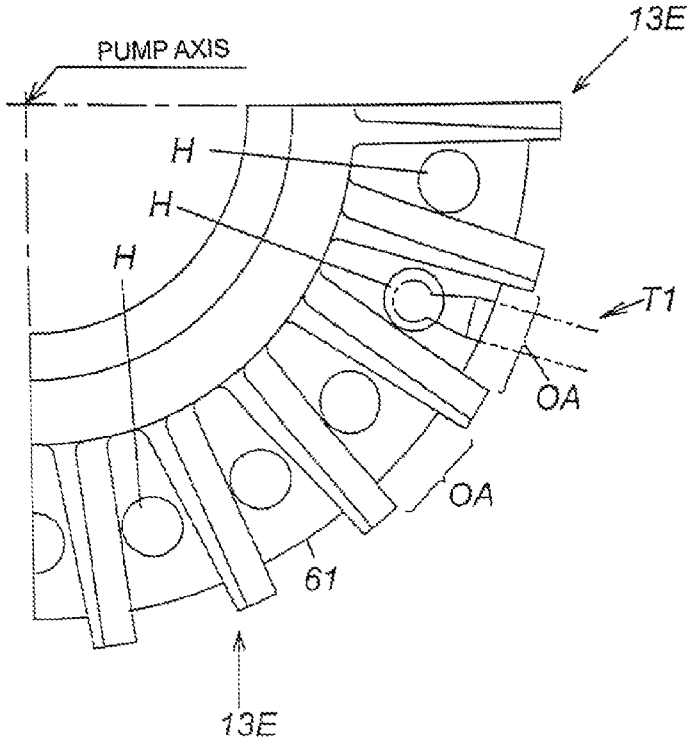

[FIG.10]
(a)
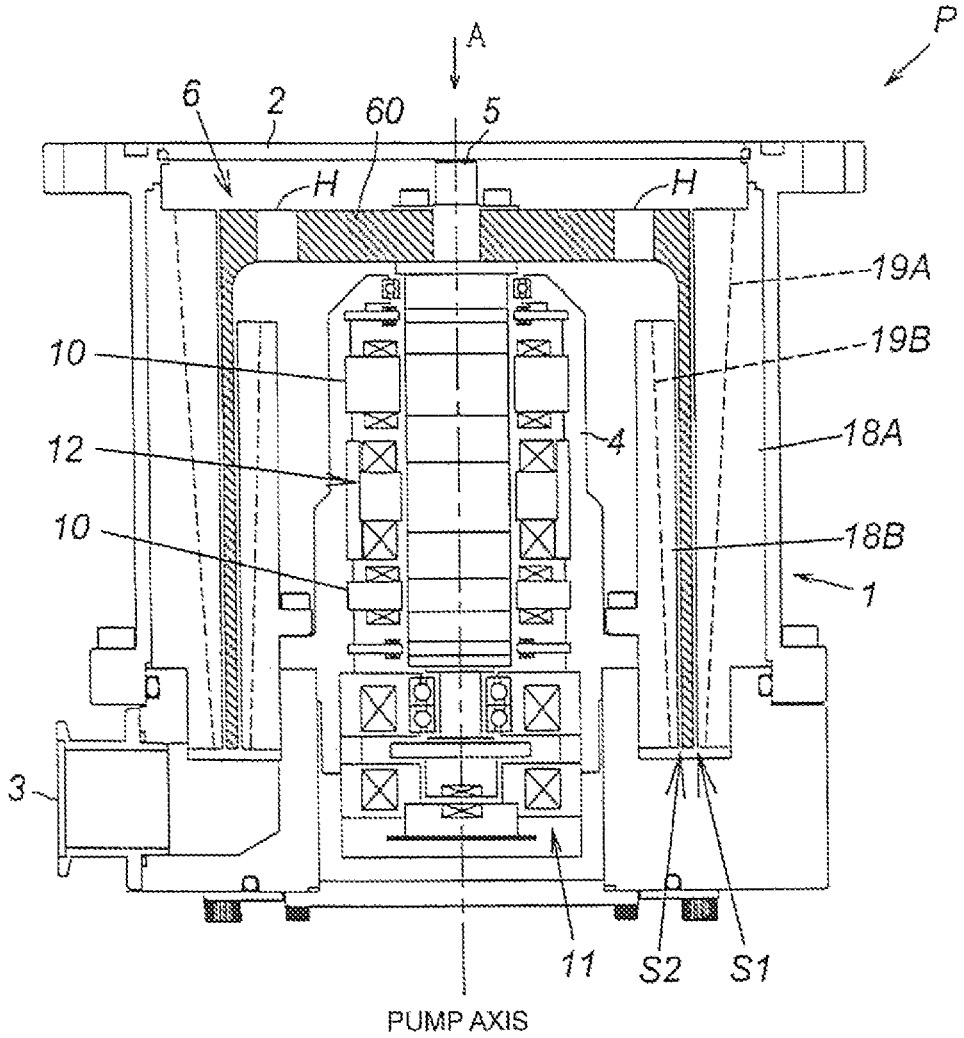
(b)
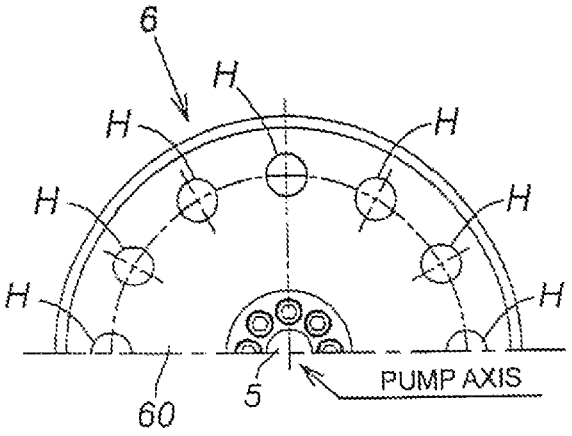

[FIG.11]
(a)
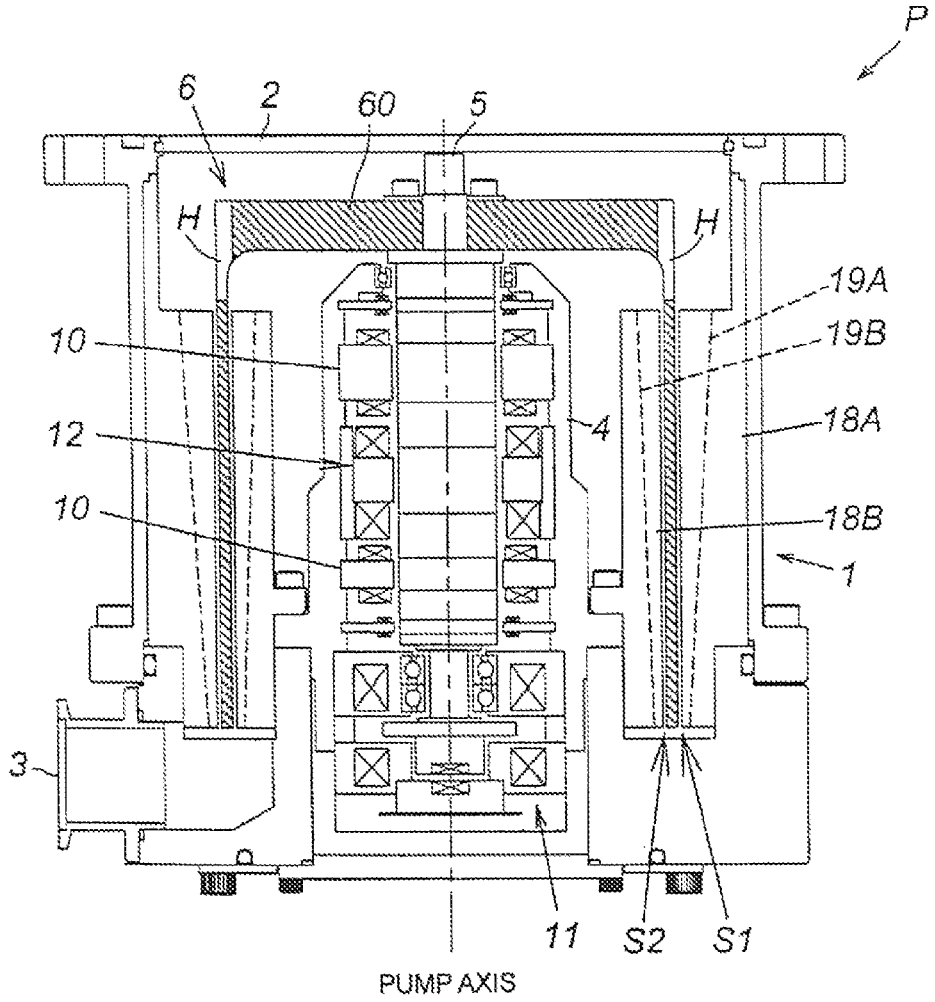
(b)
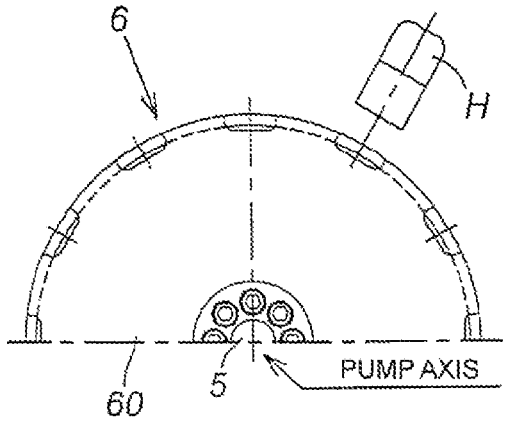

[FIG.12]
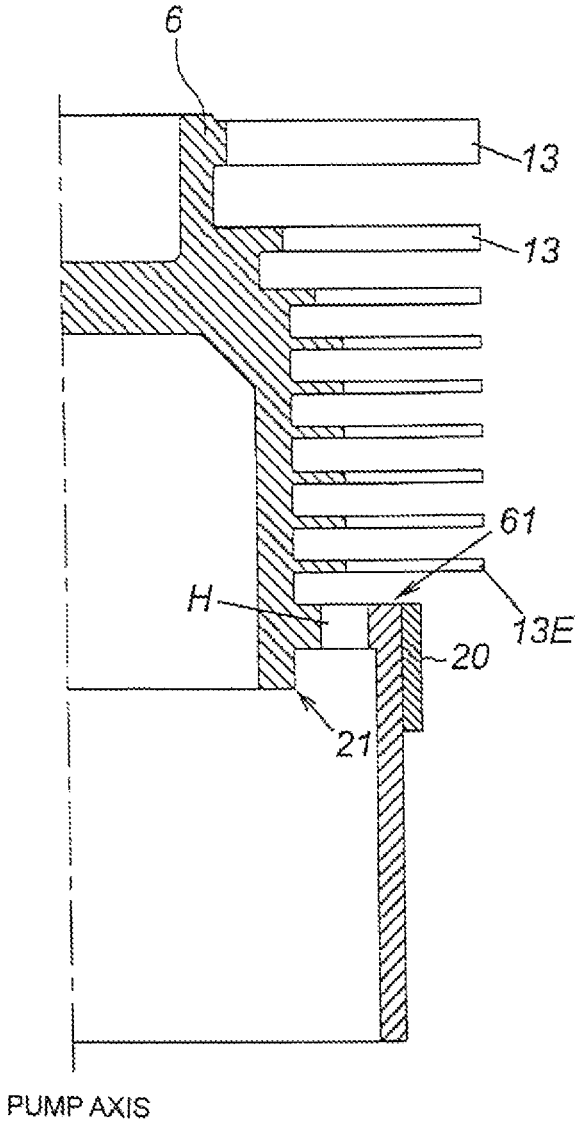

[FIG.13]
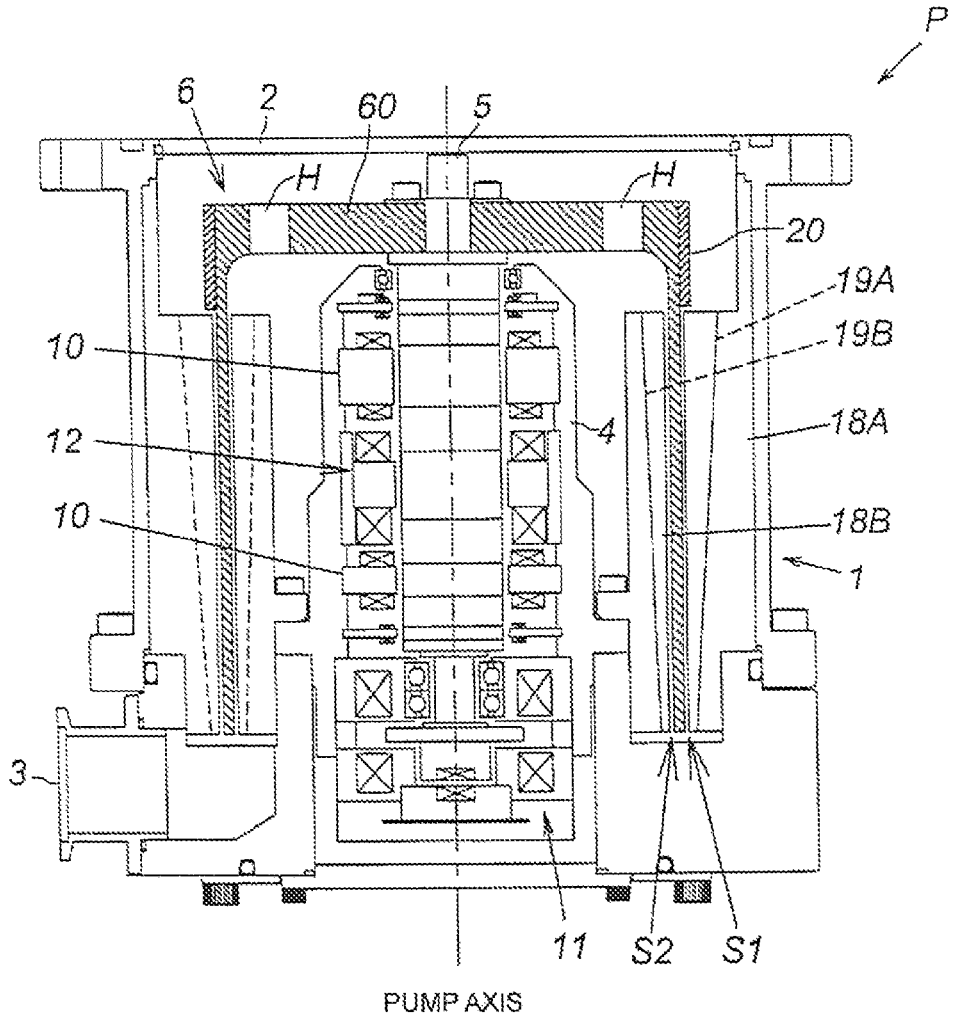

[FIG.14]
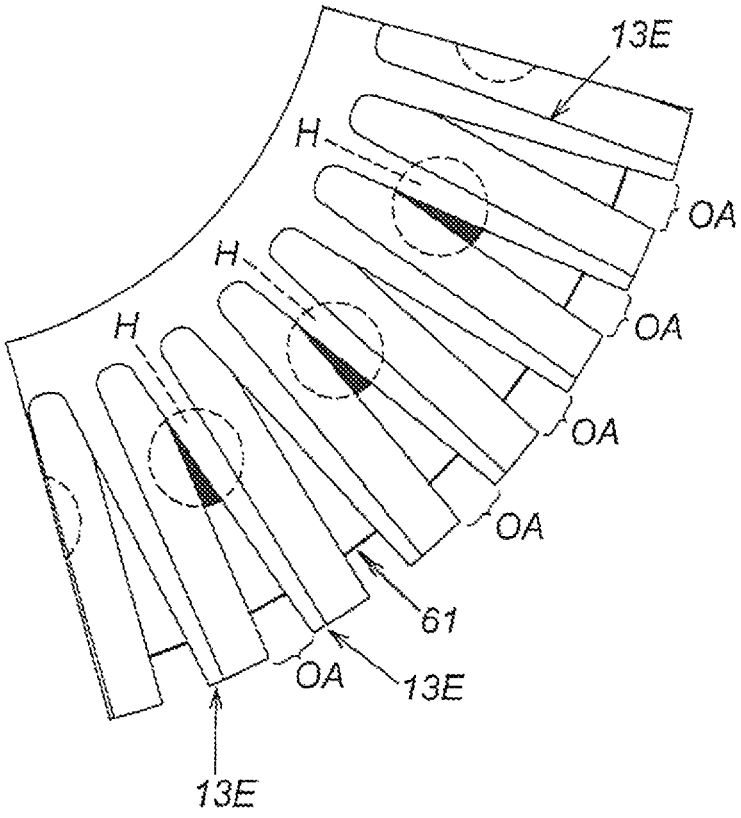

EXHAUST PUMP

BACKGROUND OF THE INVENTION

1. Field of the Invention

The present invention relates to an exhaust pump that is used, as gas evacuation means or the like, in a process chamber of a semiconductor manufacturing apparatus, a flat panel display manufacturing apparatus or a solar panel manufacturing apparatus, and in other sealed chambers; more particularly, the present invention relates to an exhaust pump exhibiting enhanced durability, processability of connecting opening portions during the production stage of the pump, and also improved evacuation performance.

2. Description of the Related Art

One known method for enhancing the evacuation performance of an exhaust pump of a type where gas is evacuated by using a thread groove, but without modifying the overall size of the pump, is, for instance, the method disclosed in Japanese Utility Model Application Laid-open No. H5-38389.

In this method, as illustrated in FIG. 1 of Japanese Utility Model Application Laid-open No. H5-38389, thread grooves (30, 31) are provided at the outer periphery and the inner periphery of a cylindrical rotating member (4a). As a result, a helical outer thread groove exhaust passage becomes formed between the cylindrical rotating member (4a) and an outer cylindrical fixed member (33) that surrounds the outer periphery of the cylindrical rotating member (4a), and a helical inner thread groove exhaust passage becomes formed between the cylindrical rotating member (4a) and an inner cylindrical fixed member (7) that is surrounded by the inner periphery of the cylindrical rotating member (4a), such that gas molecules are evacuated in parallel along these inner and outer thread groove exhaust passages.

In order to lead the gas molecules to the inner thread groove exhaust passage in the exhaust pump that utilizes the above method, however, a configuration is resorted to wherein connecting opening portions (4b) are opened at a connection ring section (unmarked with a reference numeral) of the cylindrical rotating member (4a). As a result, stress concentration arises at the edges of the connecting opening portions (4b) upon deformation of the cylindrical rotating member (4a) due to, for instance, centrifugal force and/or thermal expansion of the cylindrical rotating member (4a) when the cylindrical rotating member (4a) rotates about the axis thereof. Durability is thus problematic, in that the rotor (4) becomes likely to break from the vicinity of the connection ring section (unmarked with a reference numeral) where the connecting opening portions (4b) are formed.

In an exhaust pump that utilizes the above-mentioned method, rotor blades (5) exist above the connecting opening portions (4b), as can be seen in FIG. 1 and FIG. 2 of Japanese Utility Model Application Laid-open No. H5-38389. As a result, the connecting opening portions (4b) must be opened through insertion of a tool from a lower opening of the cylindrical rotating member (4a) into the inner periphery of the cylindrical rotating member (4a) (refer to the processing using the tool T4 of FIG. 2A) of the present application). Therefore, a long tool is required, which translates into problems of processability of the connecting opening portions (4b), for instance tool runout during opening of the connecting opening portions (4b) if the rigidity of the support system of the tool is poor.

The exhaust pump that utilizes the above method has enhanced evacuation performance. However, recent years have witnessed an increase in the size of the sealed chambers, and in the amount of gases, such as reactive gases and the like, that are used in these chambers, as dictated by the increase in size of the semiconductors, flat panels, solar panels and the like that are produced in such sealed chambers. Accordingly, yet better evacuation performance is required from exhaust pumps as means for evacuating such gases.

The reference numerals in brackets in the explanation above denote reference numerals used in Japanese Utility Model Application Laid-open No. H5-38389.

SUMMARY OF THE INVENTION

In order to solve the above problems and requests, it is an object of the present invention to provide an exhaust pump that is suitable for enhancing durability, processability of connecting opening portions in a pump production stage, and evacuation performance.

In order to attain the above goal, a first invention involves an exhaust pump that includes: a cylindrical rotating member; support means for rotatably supporting the cylindrical rotating member about an axis thereof; a driving means for rotationally driving the cylindrical rotating member; an outer cylindrical fixed member disposed so as to surround an outer periphery of the cylindrical rotating member; an inner cylindrical fixed member disposed so as to be surrounded by an inner periphery of the cylindrical rotating member; a helical outer thread groove exhaust passage provided between the cylindrical rotating member and the outer cylindrical fixed member; a helical inner thread groove exhaust passage provided between the cylindrical rotating member and the inner cylindrical fixed member; and connecting opening portions that are opened in the cylindrical rotating member and that lead a part of gas existing in the vicinity of the outer periphery of the cylindrical rotating member to the inner thread groove exhaust passage, wherein a gap between an upstream end of the connecting opening portions and lowermost stage rotor blades from among a plurality of rotor blades that are provided in multiple stages at the outer periphery of the cylindrical rotating member which is located upstream of the connecting opening portions has a dimension equal to or greater than a dimension that enables insertion, into the gap, of a tool for opening the connecting opening portions.

In the first invention, the cylindrical rotating member downstream of the lowermost stage rotor blades may have a slant tapered shape, slanting in a direction away from the lowermost stage rotor blades, at a position at which the connecting opening portions are formed, so that the gap between the upstream end of the connecting opening portions and the lowermost stage rotor blades has a dimension equal to or greater than the abovementioned dimension.

In the first invention as well, an exhaust pump includes: a cylindrical rotating member; support means for rotatably supporting the cylindrical rotating member about an axis thereof; a driving means for rotationally driving the cylindrical rotating member; an outer cylindrical fixed member disposed so as to surround an outer periphery of the cylindrical rotating member; an inner cylindrical fixed member disposed so as to be surrounded by an inner periphery of the cylindrical rotating member; a helical outer thread groove exhaust passage provided between the cylindrical rotating member and the outer cylindrical fixed member; a helical inner thread groove exhaust passage provided between the cylindrical rotating member and the inner cylindrical fixed member; and connecting opening portions that are opened in the cylindrical rotating member and that lead a part of gas existing in the vicinity of the outer periphery of the cylindrical rotating member to the inner thread groove exhaust passage, wherein an opening region between lowermost stage rotor blades and rotor blades adjacent to the lowermost stage rotor blades, from among a plurality of rotor blades that are provided in multiple stages at the outer periphery of the cylindrical rotating member which is located upstream of the connecting opening portions, has a dimension equal to or greater than a dimension that enables insertion, into the opening region, of a tool for opening the connecting opening portions.

In a second invention, an exhaust pump includes: a cylindrical rotating member; support means for rotatably supporting the cylindrical rotating member about an axis thereof; a driving means for rotationally driving the cylindrical rotating member; an outer cylindrical fixed member disposed so as to surround an outer periphery of the cylindrical rotating member; an inner cylindrical fixed member disposed so as to be surrounded by an inner periphery of the cylindrical rotating member; a helical outer thread groove exhaust passage provided between the cylindrical rotating member and the outer cylindrical fixed member; a helical inner thread groove exhaust passage provided between the cylindrical rotating member and the inner cylindrical fixed member; and connecting opening portions opened in the cylindrical rotating member and that lead a part of gas existing in the vicinity of the outer periphery of the cylindrical rotating member to the inner thread groove exhaust passage, wherein the positions of the plurality of connecting opening portions are disposed to point symmetry with respect to a pump axis of the exhaust pump.

In the second invention, the "cylindrical rotating member" denotes a member shaped as a cylinder body of uniform diameter, or a member having a shape resulting from connecting a plurality of cylinder bodies, of dissimilar diameters, along the axial direction of the cylinder bodies.

In a third invention there are provided: a cylindrical rotating member; support means for rotatably supporting the cylindrical rotating member about an axis thereof; a driving means for rotationally driving the cylindrical rotating member; an outer cylindrical fixed member disposed so as to surround an outer periphery of the cylindrical rotating member; an inner cylindrical fixed member disposed so as to be surrounded by an inner periphery of the cylindrical rotating member; a helical outer thread groove exhaust passage provided between the cylindrical rotating member and the outer cylindrical fixed member; a helical inner thread groove exhaust passage provided between the cylindrical rotating member and the inner cylindrical fixed member; connecting opening portions that are opened in the cylindrical rotating member and that lead a part of gas existing in the vicinity of the outer periphery of the cylindrical rotating member to the inner thread groove exhaust passage; and reinforcement means, provided in the cylindrical rotating member, for reinforcing the periphery of the connecting opening portions.

In the third invention, the "cylindrical rotating member" denotes a member shaped as a cylinder body of uniform diameter, or a member having a shape resulting from connecting a plurality of cylinder bodies, of dissimilar diameters, along the axial direction of the cylinder bodies.

In the third invention, the reinforcement means may have one of or both of a first reinforcement structure reducing deformation of the cylindrical rotating member at the periphery of the connecting opening portions, and a second reinforcement structure reducing deformation of the cylindrical rotating member at the periphery of the connecting opening portions.

In the first reinforcement structure, a configuration can be adopted wherein a ring comprising a high-strength material, as reinforcement member, is fitted to the outer periphery of the cylindrical rotating member, at the periphery of the connecting opening portions.

The ring may be made of a material having a lower linear expansion coefficient and a greater modulus of elasticity than those of a material that forms the cylindrical rotating member.

In a fourth invention, an exhaust pump comprises: a cylindrical rotating member; support means for rotatably supporting the cylindrical rotating member about an axis thereof; a driving means for rotationally driving the cylindrical rotating member; an outer cylindrical fixed member disposed so as to surround an outer periphery of the cylindrical rotating member; an inner cylindrical fixed member disposed so as to be surrounded an inner periphery of the cylindrical rotating member; a helical outer thread groove exhaust passage provided between the cylindrical rotating member and the outer cylindrical fixed member; a helical inner thread groove exhaust passage provided between the cylindrical rotating member and the inner cylindrical fixed member; and connecting opening portions that are opened in the cylindrical rotating member and that lead a part of gas existing in the vicinity of the outer periphery of the cylindrical rotating member to the inner thread groove exhaust passage, wherein the connecting opening portions are provided at positions that oppose opening regions of lowermost stage rotor blades from among a plurality of rotor blades that are provided in multiple stages at the outer periphery of the cylindrical rotating member which is located upstream of the connecting opening portions.

In the specific configuration of the exhaust pump in the first invention, as described above, a configuration is adopted wherein the gap that is formed between the lowermost stage rotor blades and the upstream end of the connecting opening portions has a dimension equal to or greater than a dimension that enables insertion, into the gap, of a tool for opening the connecting opening portions. Therefore, it becomes possible to open the connecting opening portions through insertion of the tool into such a gap, from the outer periphery of the cylindrical rotating member, while a short tool suffices for the opening process. In consequence, tool runout is unlikelier to occur during the opening processing of the connecting opening portions, which makes for good processability of the connecting opening portions. Also, a configuration is adopted wherein the opening regions between lowermost stage rotor blades and rotor blades that are adjacent to the lowermost stage rotor blades have a dimension equal to or greater than a dimension that enables insertion, into the opening regions, of a tool for opening the connecting opening portions. This configuration as well can elicit the same effect as above.

In the specific configuration of the exhaust pump in the second invention, as described above, a configuration is adopted wherein the plurality of connecting opening portions that are opened in the cylindrical rotating member are disposed to point symmetry with respect to a pump axis of the exhaust pump. As a result, the position of the center of gravity of the rotor is unlikelier to shift in the radial direction, and balance correction becomes easier.

In the specific configuration of the exhaust pump in the third invention, as described above, a configuration is adopted wherein the periphery of the connecting opening portions is reinforced by reinforcement means that is provided in the cylindrical rotating member. Therefore, deformation of the cylindrical rotating member at the periphery of the connecting opening portions, caused by, for instance, centrifugal force and/or thermal expansion, is reduced, and stress concentration at the edges of the connecting opening portions, caused by deformation of the cylindrical rotating member, is mitigated. As a result, the durability of the exhaust pump is enhanced in that, for instance, breakage of the cylindrical rotating member from the vicinity of the connecting opening portions becomes thus unlikelier.

In the specific configuration of the exhaust pump in the fourth invention, as described above, a configuration is adopted wherein the connecting opening portions are provided at positions that oppose opening regions of lowermost stage rotor blades from among a plurality of rotor blades that are provided in multiple stages at the outer periphery of the cylindrical rotating member upstream of the connecting opening portions. As a result, this allows the gas molecules to move smoothly and efficiently into the inner thread groove exhaust passage, through the connecting opening portions, so that the evacuation performance of the exhaust pump is enhanced.

BRIEF DESCRIPTION OF THE DRAWINGS

FIG. 1 is a cross-sectional diagram illustrating the overall configuration of an exhaust pump before the present invention is applied thereto;

FIG. 2A is a cross-sectional diagram of a cylindrical rotating member as a first embodiment, and FIG. 2B is a cross-sectional diagram of the cylindrical rotating member as a second embodiment, in a case where a first invention is used in the exhaust pump of FIG. 1;

FIG. 3A is a cross-sectional diagram of a cylindrical rotating member as a third embodiment, and FIG. 3B is a cross-sectional diagram of the cylindrical rotating member as a fourth embodiment, in a case where the first invention is used in the exhaust pump of FIG. 1;

FIG. 4A is a cross-sectional diagram of a cylindrical rotating member, as a fifth embodiment in a case where the first invention and a second invention are used in the exhaust pump of FIG. 1, and FIG. 4B is a diagram viewed from arrow A in FIG. 4A;

FIG. 5A is a cross-sectional diagram of a cylindrical rotating member, as a sixth embodiment in a case where the first invention and the second invention are used in the exhaust pump of FIG. 1, and FIG. 5B is a diagram viewed from arrow A in FIG. 5A;

FIG. 6A is a cross-sectional diagram of a cylindrical rotating member, as a seventh embodiment in a case where the first invention and the second invention are used in the exhaust pump of FIG. 1, and FIG. 6B is a diagram viewed from arrow A in FIG. 6A;

FIG. 7A is an explanatory diagram of other examples of a tool that can be used for opening connecting opening portions in the cylindrical rotating member of FIG. 2A, and of the operation of opening the connecting opening portions using that tool, and FIG. 7B is a diagram, viewed from arrow B, of the connecting opening portions that are opened using the tool of FIG. 7A;

FIG. 8A is an explanatory diagram of other examples of a tool that can be used for opening connecting opening portions in the cylindrical rotating member of FIG. 2A, and of the operation of opening the connecting opening portions using that tool, and FIG. 8B is a diagram, viewed from arrow B, of the connecting opening portions that are opened using the tool of FIG. 8A;

FIG. 9A is a cross-sectional diagram of a cylindrical rotating member, as another embodiment in a case where the first invention and the second invention are used in the exhaust pump of FIG. 1, and FIG. 9B is a diagram viewed from arrow A in FIG. 9A;

FIG. 10A is a cross-sectional diagram of an exhaust pump (of a form in which evacuation takes place only by way of a thread groove evacuation section) being an embodiment of the second invention, and FIG. 10B is a diagram viewed from arrow A in FIG. 10A;

FIG. 11A is a cross-sectional diagram of an exhaust pump (of a form in which evacuation takes place only by way of a thread groove evacuation section) being another embodiment of the second invention, and FIG. 11B is a diagram viewed from arrow A in FIG. 11A;

FIG. 12 is a cross-sectional diagram of a cylindrical rotating member in a case where a third invention is used in the exhaust pump of FIG. 1;

FIG. 13 is a cross-sectional diagram of an exhaust pump in a case where the third invention is used in another exhaust pump of structure (evacuation only by way of a thread groove evacuation section) dissimilar from that of the exhaust pump of FIG. 1; and FIG. 14 is a diagram illustrating the positional relationship between connecting opening portions and lowermost stage rotor blades in a case where the fourth invention is used in the exhaust pump of FIG. 1.

DESCRIPTION OF THE PREFERRED EMBODIMENTS

Embodiments of the present invention are explained next with reference to drawings that accompany the specification.

<<Overview of the Exhaust Pump of FIG. 1>>

FIG. 1 is a cross-sectional diagram illustrating the overall configuration of an exhaust pump before the present invention is applied thereto. An exhaust pump P in the figure is used as gas evacuation means in, for instance, a process chamber in a semiconductor manufacturing apparatus, a flat panel display manufacturing apparatus, a solar panel manufacturing apparatus, and in other sealed chambers. The exhaust pump has an outer case 1, and in the interior thereof: a blade evacuation section Pt that evacuates gas by means of rotor blades 13 and stator blades 14; a thread groove evacuation section Ps that evacuates gas by way of thread grooves 19A and 19B; and a driving system of the foregoing.

The outer case 1 is a bottomed cylinder wherein a cylindrical pump case 1A and a bottomed cylindrical pump base 1B are integrally connected, by bolts, in the cylinder axial direction. The upper end portion side of the pump case 1A is opened in the form of a gas inlet port 2. A gas outlet port 3 is provided at the lower end portion side face of the pump base 1B.

The gas inlet port 2 is connected to a sealed chamber, not shown, at high vacuum, for instance a process chamber of a semiconductor manufacturing apparatus, by way of bolts, not shown, that are provided in a flange 1C at the upper edge of the pump case 1A. The gas outlet port 3 is connected in such a way so as to communicate with an auxiliary pump not shown.

A cylindrical stator column 4, into which various electrical components are built, is provided in the central portion of the pump case 1A. The stator column 4 is erected on the pump base 1B through screwing of the lower end side of the stator column 4 to the pump base 1B.

A rotor shaft 5 is provided inside the stator column 4. The rotor shaft 5 is disposed in such a manner that the upper end portion thereof points towards the gas inlet port 2 and the lower end portion thereof points towards the pump base 1B. The rotor shaft 5 is provided in such a manner that the upper end portion thereof protrudes above the upper end face of the cylinder of the stator column 4.

The rotor shaft 5 is rotatably supported, in the radial direction and in the axial direction, by radial magnetic bearings 10 and axial magnetic bearings 11, so that, in that state, the rotor shaft 5 is rotationally driven by a driving motor 12.

The driving motor 12 is a structure that comprises a stator 12A and a rotor 12B, and is provided substantially in the vicinity of the center of the rotor shaft 5. The stator 12A of the driving motor 12 is disposed inside the stator column 4, and the rotor 12B of the driving motor 12 is integrally fitted to the outer peripheral face side of the rotor shaft 5.

The radial magnetic bearings 10 are provided as a total of two sets, one set above and one set below the driving motor 12. The axial magnetic bearings 11 are provided as one set, at the lower end portion side of the rotor shaft 5.

The two sets of radial magnetic bearings 10 comprise each: a radial electromagnet target 10A that is attached to the outer peripheral face of the rotor shaft 5, and, opposing the radial electromagnet target 10A, a plurality of radial electromagnets 10B, on the inner side face in the stator column 4, and a radial-direction displacement sensor 10C. The radial electromagnet target 10A comprises a laminate steel plate that results from stacking steel sheets of a high-permeability material. The radial electromagnets 10B draw in the rotor shaft 5 in the radial direction, via the radial electromagnet target 10A, by virtue of magnetic forces. The radial-direction displacement sensor 10C detects the radial-direction displacement of the rotor shaft 5. The rotor shaft 5 is supported through levitation by magnetic forces, at a predetermined position in the radial direction, through control of the excitation current of the radial electromagnets 10B on the basis of the detection value (radial-direction displacement of the rotor shaft 5) by the radial-direction displacement sensor 10C.

The axial magnetic bearings 11 comprise: a disc-shaped armature disc 11A that is attached to the outer-peripheral lower end portion of the rotor shaft 5; axial electromagnets 11B disposed opposing each other, flanking the armature disc 11A from above and below; and an axial-direction displacement sensor 11C that is disposed at a position slightly offset from the lower end face of the rotor shaft 5. The armature disc 11A comprises a high-permeability material. The upper and lower axial electromagnets 11B draw the armature disc 11A in the up-and-down direction of the latter, by virtue of magnetic forces. The axial-direction displacement sensor 11C detects the axial-direction displacement of the rotor shaft 5. The rotor shaft 5 is supported through levitation by magnetic forces, at a predetermined position in the axial direction, through control of the excitation current of the upper and lower axial electromagnets 11B on the basis of the detection value (axial-direction displacement of the rotor shaft 5) by the axial-direction displacement sensor 11C.

The rotor 6 is provided, as a cylindrical rotating member, outward of the stator column 4. The rotor 6 (cylindrical rotating member) is shaped as a cylinder so as to surround the outer periphery of the stator column 4. The rotor 6 is connected to the rotor shaft 5 at an upstream end portion (first connection ring section 60).

The rotor 6 is configured to a shape such that a plurality of cylinder bodies of dissimilar diameters (two, in the example of FIG. 1) is connected in the axial direction of the cylinder bodies. The cylinder bodies are connected by way of an intermediate member (second connection ring section 61) positioned at substantially the middle of the rotor 6.

The rotor 6 is configured by being integrally formed with the rotor shaft 5, as described above. As a result, the rotor 6 is rotatably supported about the axis (rotor shaft 5), by the radial magnetic bearings 10 and axial magnetic bearings 11, via the rotor shaft 5.

In the exhaust pump P of FIG. 1, the rotor shaft 5, the radial magnetic bearings 10 and the axial magnetic bearings 11 function as support means that rotatably supports the rotor 6 about the axis thereof. The rotor 6 rotates integrally with the rotor shaft 5, and hence the driving motor 12 that rotationally drives the rotor shaft 5 functions as a driving means for rotationally driving the rotor 6.

As an example of the integral structure of the rotor 6 and the rotor shaft 5, a shoulder section 9 in the exhaust pump P of FIG. 1 is formed to a stepped shape, at the outer-peripheral upper end portion of the rotor shaft 5; the upper end portion of the rotor shaft 5 above the shoulder section 9 is fitted to a boss hole 7 of the rotor 6; and the rotor 6 and the rotor shaft 5 are integrated together through screwing of the rotor 6 and the shoulder section 9.

<Detailed Configuration of the Blade Evacuation Section Pt>

The exhaust pump P of FIG. 1 is configured in such a manner that the section upstream of substantially the middle of the rotor 6 (cylindrical rotating member) (i.e. the area from substantially the middle of the rotor 6 up to the end portion of the rotor 6 on the gas inlet port 2 side) functions as the blade evacuation section Pt. The blade evacuation section Pt is explained in detail below.

The rotor blades 13 are integrally provided, as a plurality thereof, on the outer peripheral face of the rotor 6, upstream of substantially the middle of the rotor 6. The rotor blades 13 are juxtaposed radially (FIG. 9B) about the rotation axis (rotor shaft 5) of the rotor 6, or the axis (hereafter, "pump axis") of the outer case 1. The stator blades 14 are provided, as a plurality thereof, on the inner peripheral face side of the pump case 1A. The stator blades 14 are disposed side by side, radially about the pump axis. The blade evacuation section Pt is formed through alternate arrangement of the rotor blades 13 and the stator blades 14, in multiple stages, along the pump axis.

All the rotor blades 13 are blade-shaped cut products formed through cut-out in a cutting process, integrally with the outer-diameter machined portion of the rotor 6. The rotor blades 13 are tilted at an angle that is optimal for evacuation of gas molecules. All the stator blades 14 are likewise tilted at an angle that is optimal for evacuation of gas molecules.

In the blade evacuation section Pt configured as described above, the rotor shaft 5, the rotor 6 and the plurality of rotor blades 13 rotate integrally at high-speed upon startup of the driving motor 12, and the topmost-stage rotor blades 13 impart downward momentum to the gas molecules that impinge through the gas inlet port 2. These gas molecules having downward momentum are fed downward by the stator blades 14, towards the rotor blades 13 of a next stage. The above operation of imparting momentum to the gas molecules and sending the gas molecules downward is repeated over multiple stages, as a result of which the gas molecules on the gas inlet port 2 side are evacuated by migrating sequentially towards the downstream side of the rotor 6.

<Detailed Configuration of the Thread Groove Evacuation Section Ps>

In the exhaust pump P of FIG. 1, the section downstream of substantially the middle of the rotor 6 (cylindrical rotating member) (i.e. the area from substantially the middle of the rotor 6 up to the end portion of the rotor 6 on the gas outlet port 3 side) functions as the thread groove evacuation section Ps. The thread groove evacuation section Ps is explained in detail next.

The rotor 6 downstream of the substantially the middle of the rotor 6 is configured as a portion that rotates as a rotation member of the thread groove evacuation section Ps, and that is inserted/accommodated between double cylindrical thread groove evacuation section stators 18A and 18B, outward and inward in the thread groove evacuation section Ps, with a predetermined gap with respect to the thread groove evacuation section stators 18A and 18B.

From among the inner and outer double cylindrical thread groove evacuation section stators 18A and 18B, the outer thread groove evacuation section stator 18A, as an outer cylindrical fixed member, is disposed so as to surround the outer periphery of the rotor 6 (downstream of the substantially the middle of the rotor 6). A thread groove 19A the diameter whereof decreases with downward depth, so that the thread groove 19A changes into a tapered cone shape, is formed at the inner peripheral section of the outer thread groove evacuation section stator 18A. The thread groove 19A is helically carved from the upper end to the lower end of the thread groove evacuation section stator 18A, such that the thread groove 19A provides a helical thread groove exhaust passage (hereafter, "outer thread groove exhaust passage S1") between the rotor 6 and the outer thread groove evacuation section stator 18A. The lower end portion of the outer thread groove evacuation section stator 18A is supported on the pump base 1B.

The inner thread groove evacuation section stator 18B, as an inner cylindrical fixed member, is disposed so as to be surrounded by the inner periphery of the rotor 6. A thread groove 19B is likewise formed in the outer peripheral section of the inner thread groove evacuation section stator 18B, such that thread groove 19B provides a helical thread groove exhaust passage (hereafter, "inner thread groove exhaust passage S2") between the rotor 6 and the inner thread groove evacuation section stator 18B. The lower end portion of the inner thread groove evacuation section stator 18B is supported on the pump base 1B.

Although not shown in the figures, the thread grooves 19A and 19B explained above may be formed in the outer peripheral face or the inner peripheral face of the rotor 6, to provide thereby an outer thread groove exhaust passage S1 and inner thread groove exhaust passage S2 such as the ones described above.

In the thread groove evacuation section Ps, the depth of the thread groove 19A is set to be greatest on the upstream inlet side of the outer thread groove exhaust passage S1 (passage opening end that is closest to the gas inlet port 2) and to be smallest on the downstream outlet side (passage opening end that is closest to the gas outlet port 3), in order for the gas to be transported while being compressed, by virtue of the drag effect at the outer peripheral faces of the thread groove 19A and the rotor 6, and by virtue of the drag effect at the inner peripheral faces of the thread groove 19B and the rotor 6. The same is true of the thread groove 19B.

The upstream inlet of the outer thread groove exhaust passage S1 communicates with a gap G (hereafter, "final gap G") that is formed downstream of the lowermost stage rotor blades 13E, from among the rotor blades 13 that are disposed in multiple stages, and the downstream outlet of the passage S1 communicates with the gas outlet port 3 side. The upstream inlet of the inner thread groove exhaust passage S2 opens towards the inner peripheral face of the rotor 6, at substantially the middle of the rotor 6, and the downstream outlet of the passage S2 merges with the downstream outlet of the outer thread groove exhaust passage S1, and communicates thereby with the gas outlet port 3.

A plurality of connecting opening portions H is provided in the intermediate member at substantially the middle of the rotor 6. All the connecting opening portions H are formed so as to run through from the front face to the rear face of the rotor 6, so that, as a result, the connecting opening portions H have the function of causing a part of the gas that exists on the outer periphery of the rotor 6 to be led to the inner thread groove exhaust passage S2 that is positioned on the inner periphery of the rotor 6. The final gap G is a gap between the lowermost stage rotor blades 13E from among the rotor blades 13 that are disposed in multiple stages, and the upstream end of the connecting opening portions H (i.e. the end portion, on the upstream side, of the connecting opening portions H).

The gas molecules, having reached the final gap G and the upstream inlet of the outer thread groove exhaust passage S1 by being transported on account of the evacuation action of the blade evacuation section Pt, enter then into the outer thread groove exhaust passage S1, and into the inner thread groove exhaust passage S2 through the connecting opening portions H. On account of the drag effect at the thread groove 19A and the outer peripheral face of the rotor 6, and the drag effect at the thread groove 19B and the inner peripheral face of the rotor 6, the gas molecules are caused to move towards the gas outlet port 3 while being compressed from transitional flow to viscous flow, and are ultimately outletd out via an auxiliary pump not shown.

FIG. 2A is a cross-sectional diagram of a cylindrical rotating member as a first embodiment, and FIG. 2B is a cross-sectional diagram of a cylindrical rotating member as a second embodiment, in a case where the first invention is used in the exhaust pump of FIG. 1. FIG. 3A is a cross-sectional diagram of a cylindrical rotating member as a third embodiment, and FIG. 3B is a cross-sectional diagram of a cylindrical rotating member as a fourth embodiment, in a case where the first invention is used in the exhaust pump of FIG. 1.

In the exhaust pump P of FIG. 1, as described above, the rotor blades 13 are provided, in multiple stages, at the outer periphery of the rotor 6, upstream of substantially the middle of the rotor 6. In the examples of FIGS. 2A and 2B and FIGS. 3A and 3B, the final gap G is provided so as to have a dimension equal to or greater than a dimension that enables a tool T1 for opening the connecting opening portions H to be inserted in the final gap G, so that the connecting opening portions H can be opened by pushing the tool against the rotor 6, from the side of the outer peripheral face of the latter.

With reference to FIGS. 2A and 2B, in a case where the final gap G of a dimension equal to or greater than a dimension that allows insertion of the tool T1 is provided to be comparatively large, as in FIG. 2A, then setting a large insertion angle θ of the tool T1 into the final gap G makes it possible to open connecting opening portions H substantially parallelly to the axis of the rotor 6, as illustrated in FIG. 2A. In a case where, by contrast, a comparatively small final gap G is provided, as in FIG. 2B, the insertion angle θ of the tool T1 is smaller than that in the example of FIG. 2A, in order to avoid contact between the lowermost stage rotor blades 13E and the tool T1. Therefore, the connecting opening portions H are opened obliquely with respect to the pump axis, as illustrated in FIG. 2B.

In the configuration of the examples of FIGS. 2A and 2B, the portion at which the connecting opening portions H are opened below the lowermost stage rotor blades 13E is kept at a distance, to enable thereby insertion of the tool T1 into the final gap G. In the examples of FIGS. 3A and 3B, a configuration is resorted to wherein the portion at which the connecting opening portions H are opened is imparted with a slant tapered shape that slants in a direction away from the lowermost stage rotor blades 13E; as a result, the dimension of the final gap G becomes equal to or greater than the abovementioned dimension (equal to or greater than the dimension that enables insertion of the tool T1 for opening the connecting opening portions H). In the present embodiment, the final gap G is a gap between the lowermost stage rotor blades 13E, from among the rotor blades 13 that are disposed in multiple stages, and the position of the connecting opening portions H that stands further on the downstream side, at the upstream end.

With respect to FIGS. 3A and 3B, in a case where an inclination angle α of the tapered shape is set to be comparatively large, as in FIG. 3A, the connecting opening portions H can be opened to be substantially parallel to the pump axis, as illustrated in FIG. 3A, by setting a large insertion angle θ of the tool T1 into the final gap G. In a case where, by contrast, the inclination angle α of the tapered shape is comparatively small, as in FIG. 3B, the insertion angle θ of the tool T1 is smaller than that in the example of FIG. 3A, in order to avoid contact between the lowermost stage rotor blades 13E and the tool T1. Therefore, the connecting opening portions H are opened obliquely with respect to the pump axis, as illustrated in FIG. 3B.

In the examples of FIGS. 2A and 2B and FIGS. 3A and 3B, as explained above, a specific configuration of the exhaust pump P is adopted wherein a dimension of the final gap G that is formed downstream of the lowermost stage rotor blades 13E is equal to or greater than a dimension that enables insertion, through the final gap G, of the tool T1 for opening the connecting opening portions H. As a result, it becomes possible to open the connecting opening portions H through insertion of the tool into such a final gap G, while a short tool suffices for the opening process. In consequence, tool runout is unlikelier to occur during the opening processing of the connecting opening portions H, which makes for good processability of the connecting opening portions H.

FIG. 4A is a cross-sectional diagram of a cylindrical rotating member, as a fifth embodiment in a case where the first invention and the second invention are used in the exhaust pump of FIG. 1, and FIG. 4B is a diagram of FIG. 4A viewed from arrow A. FIG. 5A is a cross-sectional diagram of a cylindrical rotating member, as a sixth embodiment in a case where the first invention and the second invention are used in the exhaust pump of FIG. 1, and FIG. 5B is a diagram of FIG. 5A viewed from arrow A. FIG. 6A is a cross-sectional diagram of a cylindrical rotating member, as a seventh embodiment in a case where the first invention and the second invention are used in the exhaust pump of FIG. 1, and FIG. 6B is a diagram of FIG. 6A viewed from arrow A. Although not shown in the figures, the connecting opening portions H in these embodiments are disposed to point symmetry with respect to the pump axis.

In the examples of FIG. 4A, FIG. 5A and FIG. 6A, the points at which a tool T5 is inserted into the final gap G from the outer periphery of the rotor 6 are identical to those of the examples in FIG. 2A, FIG. 2B, FIG. 3A and FIG. 3B. Unlike in the latter examples, herein a tool T5 is inserted in a direction substantially perpendicular to the pump axis direction, and the tool T5 is displaced along the pump axis direction to open thereby the connecting opening portions H. Therefore, the connecting opening portions H become shaped now as grooves (FIG. 4B, FIG. 5B and FIG. 6B).

In the example of FIG. 4A, the insertion amount of the tool T5 (hereafter, "tool insertion amount") in a direction substantially perpendicular to the pump axis direction is small, whereas the travel of the tool T5 in the pump axis direction (hereafter, "tool travel") is large. Specifically, the tool insertion amount is set to the depth from the outer peripheral face to the inner peripheral face of the rotor 6 (distance corresponding to substantially the wall thickness of the outer periphery of the rotor 6 at the portion where the connecting opening portions H are formed), and the tool travel is set to be equal to or greater than the wall thickness of the rotor 6. In such a case, the connecting opening portions H opened by the tool T5 are formed as in FIGS. 4A and 4B. In the example of FIG. 4A, as in FIG. 4B, the connecting opening portions H are provided as a plurality thereof, and are arranged in such a manner that the positions of the plurality of connecting opening portions H are disposed to point symmetry with respect to the pump axis of the exhaust pump P. As a result, the position of the center of gravity of the rotor 6 is unlikelier to shift in the radial direction, and balance correction becomes easier.

In the example of FIG. 5A, the tool insertion amount is increased, and the tool travel reduced, with respect to those in the example of FIG. 4A. Specifically, the tool insertion amount is set to be equal to or greater than the depth from the outer peripheral face to the inner peripheral face of the rotor 6, and the tool travel is set to be equivalent to the wall thickness of the rotor 6. In such a case, the connecting opening portions H opened by the tool T5 are formed as in FIGS. 5A and 5B. In the example of FIG. 5A, as in FIG. 5B, the connecting opening portions H are provided as a plurality thereof, and are arranged in such a manner that the positions of the plurality of connecting opening portions H are disposed to point symmetry with respect to the pump axis of the exhaust pump P. As a result, the position of the center of gravity of the rotor 6 is unlikelier to shift in the radial direction, and balance correction becomes easier.

In the example of FIG. 6A, the tool insertion amount is increased, and the tool travel is likewise increased, with respect to those in the example of FIG. 4 (the tool insertion amount is identical to, and the tool travel greater than, those in the example of FIG. 5A). Specifically, the tool insertion amount is set to be equal to or greater than the depth from the outer peripheral face to the inner peripheral face of the rotor 6, and the tool travel is set to be equal to or greater than the wall thickness of the rotor 6. In such a case, the connecting opening portions H opened by the tool T5 are formed as in FIGS. 6A and 6B. In the example of FIG. 6A, as in FIG. 6B, the connecting opening portions H are provided as a plurality thereof, and are arranged in such a manner that the positions of the plurality of connecting opening portions H are disposed to point symmetry with respect to the pump axis of the exhaust pump P. As a result, the position of the center of gravity of the rotor 6 is unlikelier to shift in the radial direction, and balance correction becomes easier.

FIG. 7A and FIG. 8A are explanatory diagrams of other examples of tools that can be used for opening the connecting opening portions H in the rotor 6 of FIG. 2A, and of the operation of opening the connecting opening portions H using these tools. FIG. 7B is a diagram, viewed from arrow B, of the connecting opening portions H that are opened using the tool of FIG. 7A and FIG. 8B is a diagram, viewed from arrow B, of the connecting opening portions H that are opened using the tool of FIG. 8A.

FIG. 2A illustrates an example wherein a tool T1 is prepared that has cutting portion, not shown, formed at a ball 31 at the tip of a tool spindle 30, and the connecting opening portions H are formed through oblique pushing of the tool T1 against the surface of the rotor 6. However, the tool is not limited to such an example. For instance, a tool T2 may be prepared wherein a cutting portion, not shown, is formed at the outer periphery of a circular plate body 32 at the tip of the tool spindle 30, as illustrated in FIG. 7A, so that the connecting opening portions H are then opened through parallel displacement of the tool T2 along the pump axis while the tool T2 presses horizontally against the surface of the rotor 6. In this case, the connecting opening portions H that are opened are holes the cross section whereof has a substantially quadrangular shape, as illustrated in FIG. 7B. The corners are imparted with a round shape in order to mitigate stress concentration. In a tool T3 in FIG. 8A, the portion of the ball 31 is of larger diameter than in the tool T1 of FIG. 2A. The connecting opening portions H may be opened through parallel displacement of the tool T3 along the pump axis while the tool T3 presses horizontally against the surface of the rotor 6. In this case, the connecting opening portions H that are opened become shaped as holes the cross section whereof is circular, as illustrated in FIG. 8B FIG. 9A is a cross-sectional diagram of a cylindrical rotating member, as another embodiment in a case where the first invention and the second invention are used in the exhaust pump of FIG. 1, and FIG. 9B is diagram of FIG. 9A viewed from arrow A. Although not shown in the figures, the connecting opening portions H in the present embodiment are disposed to point symmetry with respect to the pump axis.

The lowermost stage rotor blades 13E in the exhaust pump P of FIG. 1 can be provided in a radially juxtaposed manner about the pump axis, as illustrated in FIG. 9B, in such a manner that respective opening regions OA between mutually adjacent rotor blades 13E are wider than those in the below-described example of FIG. 14. In the configuration of FIG. 9B, specifically, the width of the dimension of the opening regions OA is equal to or greater than a dimension that enables insertion, into the opening regions OA, of the tool T1 for opening the connecting opening portions H. Such a configuration allows the tool to pass through the opening regions OA of the lowermost stage rotor blades 13E, and hence the connecting opening portions H can be processed even if the dimension of the final gap G is smaller than the dimension that enables insertion of the tool. In the example of FIG. 9A, as in FIG. 9B, the connecting opening portions H are provided as a plurality thereof, and are arranged in such a manner that the positions of the plurality of connecting opening portions H are disposed to point symmetry with respect to the pump axis of the exhaust pump P. As a result, the position of the center of gravity of the rotor 6 is unlikelier to shift in the radial direction, and balance correction becomes easier.

FIG. 10A is a cross-sectional diagram of an exhaust pump (of a form in which evacuation takes place only at the thread groove evacuation section) being an embodiment of the second invention, and FIG. 10B is diagram of FIG. 10A viewed from arrow A. The exhaust pump P in FIG. 10A is an exhaust pump (drag pump) of a type wherein the exhaust pump P in FIG. 1 explained above is provided with the thread groove evacuation section Ps alone. Members shared with the exhaust pump P of FIG. 1 are denoted with the same reference numerals, and a detailed explanation thereof will be omitted.

In a basic pump configuration, the exhaust pump P of FIG. 10A comprises: the rotor 6 (cylindrical rotating member); support means (radial magnetic bearings 10 and axial magnetic bearings 11) for rotationally supporting the rotor 6 about the axis (rotor shaft 5) thereof; the driving motor 12 (a driving means) that rotationally drives the rotor 6; the outer thread groove evacuation section stator 18A (outer cylindrical fixed member) disposed so as to surround the outer periphery of the rotor 6; the inner thread groove evacuation section stator 18B (inner cylindrical fixed member) disposed so as to be surrounded by the inner periphery of the rotor 6; the helical outer thread groove exhaust passage S1 provided between the rotor 6 and the outer thread groove evacuation section stator 18A; the helical inner thread groove exhaust passage S2 provided between the rotor 6 and the inner thread groove evacuation section stator 18B; and the connecting opening portions H, opened in the rotor 6, that lead a part of the gas that exists in the vicinity of the outer periphery of the rotor 6 towards the inner thread groove exhaust passage S2. The exhaust pump P of FIG. 10A has no blade evacuation section Pt, such as the one in the exhaust pump P of FIG. 1. Therefore, the rotor 6 in the exhaust pump P of FIG. 10A is shaped as a cylinder body of uniform diameter, as illustrated in the figure.

In the exhaust pump P of FIG. 10A, the connecting opening portions H are provided as a plurality thereof, and are arranged in such a manner that the positions of the plurality of connecting opening portions H are disposed to point symmetry with respect to the pump axis of the exhaust pump P, as illustrated in FIG. 10B. As a result, the position of the center of gravity of the rotor 6 is unlikelier to shift in the radial direction, and balance correction becomes easier.

The plurality of connecting opening portions H of FIG. 10A can be opened in the outer peripheral face (side face) of the rotor 6, for instance as illustrated in FIG. 11A. In this case as well, an effect whereby the position of the center of gravity of the rotor 6 is unlikelier to shift in the radial direction, and balance correction becomes easier, is likewise achieved through an arrangement where the positions of the plurality of connecting opening portions H are point-symmetrical with respect to the pump axis of the exhaust pump P, as illustrated in FIG. 11B.

FIG. 12 is a cross-sectional diagram of the cylindrical rotating member in a case where the third invention is used in the exhaust pump of FIG. 1. In the example of FIG. 12, reinforcement means is provided in the rotor 6, as means for reinforcing the periphery of the connecting opening portions H, in order to mitigate stress concentration that occurs at the edges of the connecting opening portions H that are formed in the rotor 6. This reinforcement means relies on a first reinforcement structure wherein deformation of the rotor 6 at the periphery of the connecting opening portions H, caused by, for instance, centrifugal force and/or thermal expansion, is reduced through attachment of a reinforcement member 20 to the outer periphery of the rotor 6 on the periphery of the connecting opening portions H, and a second reinforcement structure wherein deformation of the rotor 6 at the periphery of the connecting opening portions H, caused by, for instance, centrifugal force and/or thermal expansion, is reduced through formation of a projecting portion 21 at the inner periphery of the rotor 6, at substantially the middle in the pump axis direction.

In the reinforcement member 20, a ring comprising a high-strength material such as AFPR (aramid fiber-reinforced plastic), BFRP (boron fiber-reinforced plastic), CFRP (carbon fiber-reinforced plastic), DFRP (polyethylene fiber-reinforced plastic), GFRP (glass fiber-reinforced plastic) or the like, is fitted to the outer peripheral face of the rotor 6, as illustrated in FIG. 12; as a result, deformation of the rotor 6 at the periphery of the connecting opening portions H can be reduced, and stress concentration that occurs at the edge portions of the connecting opening portions H can be likewise mitigated.

In order to further increase the effect of reducing deformation of the rotor 6 elicited by the reinforcement member 20 having such a ring form, the reinforcement member 20 is preferably formed out of a material having a lower linear expansion coefficient, and a greater modulus of elasticity, than those of the material that forms the rotor 6. The rotor 6 is often produced out of an aluminum alloy, and hence the abovementioned high-strength materials can be appropriately used as the materials that form the reinforcement member 20.

The projecting portion 21 is formed in such a manner that the inner wall portion of the rotor 6 upstream of the connecting opening portions H projects downward of the rotor 6, as illustrated in FIG. 12, so that, as a result, there is elicited the same effect as that of the reinforcement member 20 described above.

FIG. 13 is a cross-sectional diagram of an exhaust pump in a case where the third invention is used in another exhaust pump of structure (evacuation only by way of a thread groove evacuation section) dissimilar from that of the exhaust pump of FIG. 1. The basic configuration of the exhaust pump of FIG. 13 is identical to that of the exhaust pump P of FIG. 10A and FIG. 11A described above, and hence a detailed explanation will be omitted. In the exhaust pump of FIG. 13 as well, reinforcement means, as means for reinforcing the periphery of the connecting opening portions H, is provided in the rotor 6. Through attachment of the reinforcement member 20 to the outer periphery of the rotor 6 at the periphery of the connecting opening portions H, this reinforcement means reduces deformation of the rotor 6 at the periphery of the connecting opening portions H, caused by, for instance, centrifugal force and/or thermal expansion, as in the case of the first reinforcement structure explained above.

In the examples of FIG. 12 and FIG. 13 explained above, a specific configuration of the exhaust pump P is adopted wherein the periphery of the connecting opening portions H is reinforced by the reinforcement means (reinforcement member 20 or projecting portion 21) that is provided in the rotor 6. Therefore, the durability of the exhaust pump P is enhanced in that deformation of the rotor 6 at the periphery of the connecting opening portions H, caused by, for instance, centrifugal force and/or thermal expansion, is reduced; also, stress concentration that occurs at the edges of the connecting opening portions H, caused by deformation of the rotor 6, is mitigated, and breakage of the rotor 6 from the vicinity of the connecting opening portions H becomes thus unlikelier.

FIG. 14 is a diagram illustrating the positional relationship between the connecting opening portions and the lowermost stage rotor blades in a case where the fourth invention is used in the exhaust pump of FIG. 1.

In the exhaust pump P of FIG. 1, as explained above, the rotor blades 13 are provided, in multiple stages, at the outer periphery of the rotor 6, upstream of substantially the middle the rotor 6. The lowermost stage rotor blades 13E are provided in a radially juxtaposed manner about the pump axis, as illustrated in FIG. 14, in such a manner that the spaces between mutually adjacent rotor blades 13E constitute opening regions OA. Although not shown in the figure, identical opening regions are provided in the respective rotor blades 13 at stages higher than the lowermost stage rotor blades 13E. Light gas molecules that are positioned between the lowermost stage rotor blades 13E and rotor blades one stage higher up pass through the opening regions OA of such lowermost stage rotor blades 13E, and move as a result towards the connecting opening portions H.

Given the way (route) in which such light gas molecules migrate, a configuration is adopted, in the example of FIG. 14, wherein the connecting opening portions H of the rotor 6 are provided at positions that oppose the opening regions OA of the lowermost stage rotor blades 13E. Such a configuration allows the gas molecules to move smoothly and efficiently into the inner thread groove exhaust passage S2, through the connecting opening portions H, so that the evacuation performance of the exhaust pump P is enhanced.

In the above explanation, for convenience, embodiments of the first through fourth invention have been explained individually, but these embodiments may be combined in various ways.

EXPLANATION OF REFERENCE NUMERALS

1 outer case
1A pump case
1B pump base
1C flange
2 gas inlet port
3 gas outlet port
4 stator column
5 rotor shaft
6 rotor (cylindrical rotating member)
60 first connection ring section
61 second connection ring section
7 boss hole
9 shoulder section
10 radial magnetic bearings
10A radial electromagnet target
10B radial electromagnet
10C radial-direction displacement sensor
11 axial magnetic bearings
11A armature disc
11B axial electromagnet
11C axial-direction displacement sensor
12 driving motor
12A stator
12B rotor
13 rotor blade
13E lowermost stage rotor blades
14 stator blade
18A outer thread groove evacuation section stator (outer cylindrical fixed member)
18B inner thread groove evacuation section stator (inner cylindrical fixed member)
19A, 19B thread groove
20 reinforcement member
21 projecting portion

30 tool spindle
31 ball
32 circular plate body
G final gap (gap between lowermost stage rotor blades and upstream end of connecting opening portions)
H connecting opening portions
OA rotor blade opening region
P exhaust pump
Pt blade evacuation section
Ps thread groove evacuation section
S1 outer thread groove exhaust passage
S2 inner thread groove exhaust passage
T1, T2, T3, T4, T5 tool

What is claimed is:

1. An exhaust pump, comprising:

a cylindrical rotating member;

support means for rotatably supporting said cylindrical rotating member about an axis thereof;

a driving means for rotationally driving said cylindrical rotating member;

an outer cylindrical fixed member disposed so as to surround an outer periphery of said cylindrical rotating member;

an inner cylindrical fixed member disposed so as to be surrounded by an inner periphery of said cylindrical rotating member;

a helical outer thread groove exhaust passage provided between said cylindrical rotating member and said outer cylindrical fixed member;

a helical inner thread groove exhaust passage provided between said cylindrical rotating member and said inner cylindrical fixed member; and connecting opening portions that are opened in said cylindrical rotating member and that lead a part of gas existing in the vicinity of the outer periphery of said cylindrical rotating member to said inner thread groove exhaust passage, wherein said cylindrical rotating member comprises a cylinder body located between said outer cylindrical fixed member and said inner cylindrical fixed member and a connection section extended to said axis from said cylinder body, at least a part of the connecting opening portions are processed parallel to the axis so as to run through, said connecting opening portions comprises a horizontal hole in said cylinder body and a vertical hole in said connection section;

and a dimension of a gap between an upstream end of said connecting opening portions and lowermost stage rotor blades from among a plurality of rotor blades that are provided in multiple stages at the outer periphery of said cylindrical rotating member which is located upstream of said connecting opening portions has a dimension needed to insert a tool for opening said connecting opening portions into said gap from an outer periphery of said cylindrical rotating member.

2. The exhaust pump according to claim 1, wherein said cylindrical rotating member downstream of said lowermost stage rotor blades has a slant tapered shape slanting in a direction away from said lowermost stage rotor blades at a position at which said connecting opening portions are formed so that said gap between said upstream end of said connecting opening portions and said lowermost stage rotor blades has the dimension needed to insert the tool for opening said connecting opening portions.

3. An exhaust pump, comprising:

a cylindrical rotating member;

a support means for rotatably supporting said cylindrical rotating member about an axis thereof;

a driving means for rotationally driving said cylindrical rotating member;

an outer cylindrical fixed member disposed so as to surround an outer periphery of said cylindrical rotating member;

an inner cylindrical fixed member disposed so as to be surrounded by an inner periphery of said cylindrical rotating member;

a helical outer thread groove exhaust passage provided between said cylindrical rotating member and said outer cylindrical fixed member;

a helical inner thread groove exhaust passage provided between said cylindrical rotating member and said inner cylindrical fixed member; and connecting opening portions that are opened in said cylindrical rotating member and that lead a part of gas existing in the vicinity of the outer periphery of said cylindrical rotating member to said inner thread groove exhaust passage, a lowermost stage of rotor blades, wherein a rotor blade in the lowermost stage is separated from an adjacent rotor blade in the lowermost stage by an opening region;

wherein the opening region has a dimension that enables insertion, into said opening region between the rotor blade and the adjacent rotor blade, of a tool for opening one of said connecting opening portions.

4. The exhaust pump according to claim 1, wherein positions of said plurality of connecting opening portions are disposed to point symmetry with respect to a pump axis of said exhaust pump.

5. The exhaust pump according to claim 1, wherein reinforcement means, provided in said cylindrical rotating member, for reinforcing the periphery of said connecting opening portions.

6. The exhaust pump according to claim 5, wherein said reinforcement means comprises one of or both of:

a first reinforcement structure reducing deformation of the cylindrical rotating member at the periphery of the connecting opening portions by attaching a reinforcement member to the outer periphery of the cylindrical rotating member, at the periphery of said connecting opening portions, and a second reinforcement structure reducing deformation of the cylindrical rotating member at the periphery of the connecting opening portions by forming a projecting portion at the inner periphery of the cylindrical rotating member, at the periphery of the connecting opening portions.

7. The exhaust pump according to claim 6, wherein in said first reinforcement structure, as said reinforcement member a ring made of a high strength material is fitted to the outer periphery of the cylindrical rotating member at the periphery of said connecting opening portions.

8. The exhaust pump according to claim 7, wherein said ring is made of a material having a lower linear expansion coefficient and a greater modulus of elasticity than those of a material that forms said cylindrical rotating member.

9. An exhaust pump, comprising:

a cylindrical rotating member;

support means for rotatably supporting said cylindrical rotating member about an axis thereof;

a driving means for rotationally driving said cylindrical rotating member;

an outer cylindrical fixed member disposed so as to surround an outer periphery of said cylindrical rotating member;

an inner cylindrical fixed member disposed so as to be surrounded by an inner periphery of said cylindrical rotating member;

a helical outer thread groove exhaust passage provided between said cylindrical rotating member and said outer cylindrical fixed member;

a helical inner thread groove exhaust passage provided between said cylindrical rotating member and said inner cylindrical fixed member; and connecting opening portions that are opened in said cylindrical rotating member and that lead a part of gas existing in the vicinity of the outer periphery of said cylindrical rotating member to said inner thread groove exhaust passage, a lowermost stage of rotor blades wherein a rotor blade in the lowermost stage is separated from an adjacent rotor blade in the lowermost stage by an opening region;

wherein one of said connecting opening portions is provided at a position directly below and aligned with the opening region between the rotor blade of the lowermost stage of rotor blades and the adjacent rotor blade of the lowermost stage of rotor blades.

* * * * *